US005346123A

United States Patent [19]

Lombardo

[11] Patent Number: 5,346,123

[45] Date of Patent: Sep. 13, 1994

[54] MAILER TYPE BUSINESS FORM AND INTERMEDIATE WITH BUILT IN REPLY ENVELOPE

[75] Inventor: Leo Lombardo, Manchester, N.H.

[73] Assignee: Moore Business Forms, Inc., Grand Island, N.Y.

[21] Appl. No.: 34,544

[22] Filed: Mar. 19, 1993

[51] Int. Cl.[5] ..... B65D 27/06

[52] U.S. Cl. ..... 229/305; 229/69; 229/92.1

[58] Field of Search ..... 229/92.1, 69, 70, 300, 229/301, 302, 305, 314

[56] References Cited

U.S. PATENT DOCUMENTS

| | | | |
|---|---|---|---|
| 3,018,033 | 1/1962 | Henry . | |
| 3,126,148 | 3/1964 | Hanson | 229/92.1 |
| 3,143,279 | 8/1964 | Black . | |
| 3,255,952 | 6/1966 | Black . | |
| 3,507,519 | 4/1970 | McNabb | 229/305 X |
| 3,652,007 | 3/1972 | MacDougall . | |
| 3,946,938 | 3/1976 | Kranz | 229/305 |
| 3,955,750 | 5/1976 | Huffman | 229/92.1 X |
| 4,044,942 | 8/1977 | Sherwood . | |
| 4,575,121 | 3/1986 | Conti . | |
| 4,830,269 | 5/1989 | Jenkins . | |
| 5,172,855 | 12/1992 | Coffey | 229/305 |
| 5,193,850 | 3/1993 | Lombardo . | |
| 5,201,464 | 4/1993 | File . | |

*Primary Examiner*—Allan N. Shoap
*Assistant Examiner*—Jes F. Pascua
*Attorney, Agent, or Firm*—Nixon & Vanderhye

[57] ABSTRACT

A mailer type business form, and intermediate, are constructed from a single sheet of paper having four virtually identically sized panels, the sheet folded about an intermediate fold line, and then two other fold lines, to form a four ply mailer. First and fourth panels of the intermediate define the third and fourth plies of the mailer, and provide a return envelope sealed along three edges and open at the fourth, with a flap provided with a rewettable adhesive strip at the open edge. The second and third panels are held together by longitudinal strips of adhesive adjacent the longitudinal edges of those panels, with perforations provided in the second and third panels (but not the first and fourth panels) to allow removal of the connecting adhesive. The fold lines connecting the first and second panels and third and fourth panels are preferably perforations, and a longitudinal perforation is provided in the second panel to form the statement and reminder portions. All variable printing on the intermediate is provided on the second face of the sheet (which includes the outgoing address in the third panel, and the reply address in the first panel) so that the mailer may be constructed by simplex imaging.

21 Claims, 4 Drawing Sheets

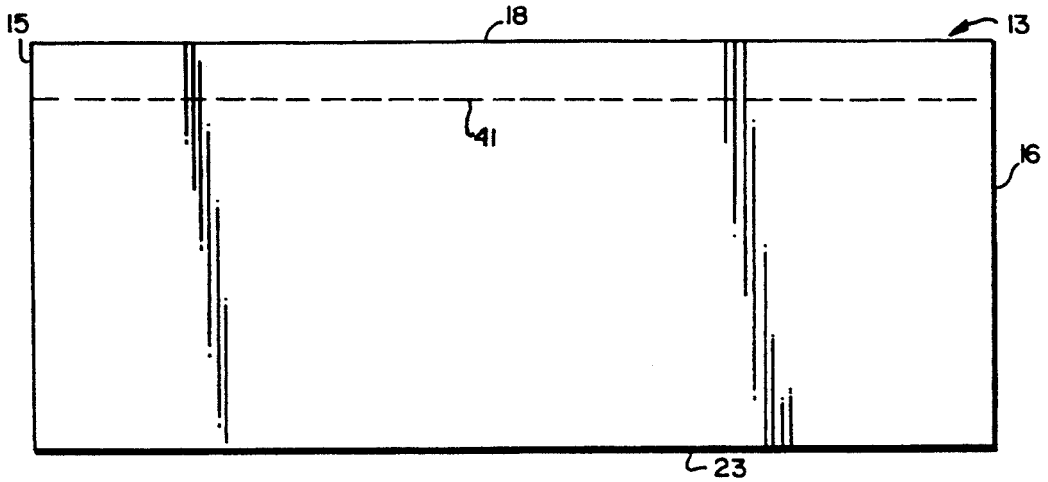
FIG. 5
FIG. 6
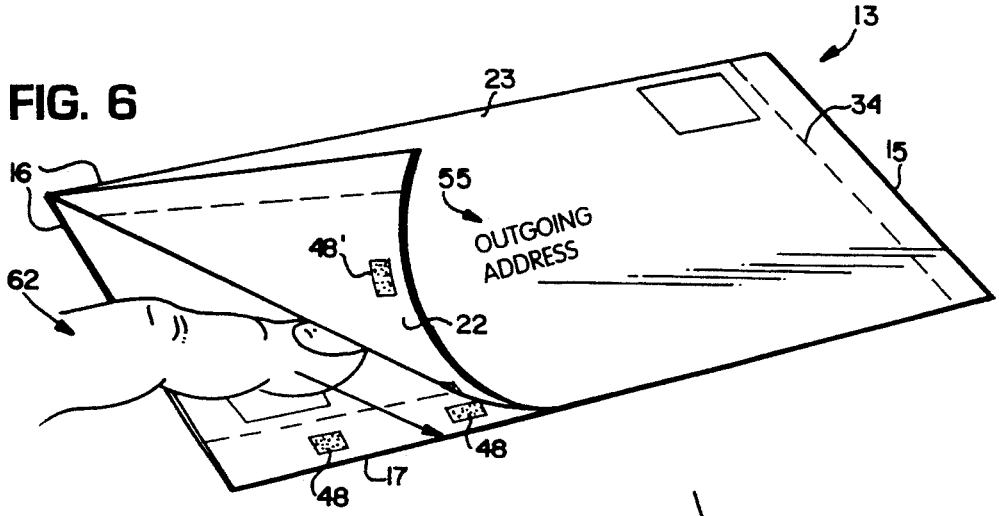
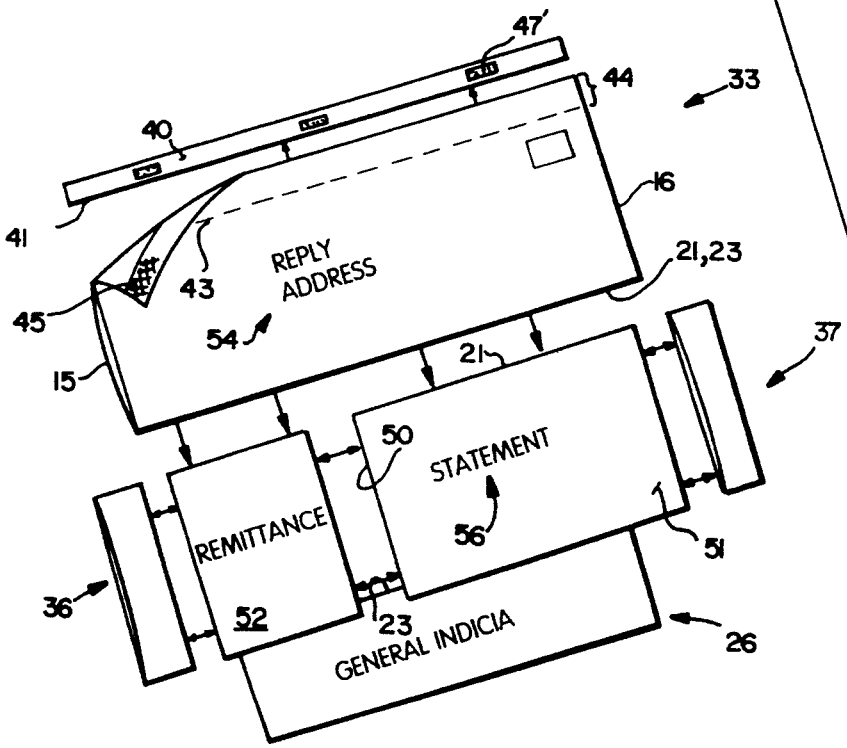
FIG. 7

MAILER TYPE BUSINESS FORM AND INTERMEDIATE WITH BUILT IN REPLY ENVELOPE

BACKGROUND AND SUMMARY OF THE INVENTION

In co-pending application Ser. No. 07/891,035 filed Jun. 1, 1992, a double folded mailer was provided preferably formed using pressure activated cohesive as the permanent adhesive for sealing components of the form together, and useful with the SPEEDISEALER® pressure seal equipment manufactured by Moore Business Forms, Inc. of Lake Forest, Ill. While the mailer described in that co-pending application has a great deal of area that can be printed, to provide a large amount of information on the mailer, and is easily constructed from a single sheet (either a continuous or cut sheet), it is somewhat limited in applications in that it does not include a built in return envelope.

According to the present invention, a mailer made from a single sheet of double folded paper, having a amount of area for printing of both variable and non-variable information, is provided. The construction is such that the variable information may be simplex printed on the form, which may be either in cut sheet continuous format. Additionally, the form according to the invention includes a built in reply envelope that covers the full width of the form, and is easy to access. The mailer according to the invention is also easy to open although it will remain integral during mailing.

According to one aspect of the present invention, a mailer type business form intermediate is provided. The intermediate comprises the following elements: A sheet of paper having first and second opposite parallel longitudinal edges; first and second opposite end edges; a first face adapted to provide the majority of the interior of a mailer when constructed from the sheet; and a second face adapted to provide the exterior of the mailer when constructed. First, second and third fold lines formed in the sheet perpendicular to the longitudinal edges, and dividing the sheet into, in sequence, first, second, third, and fourth panels of virtually identical size, the first panel being defined by the first end edge and the first fold line, and the fourth panel by the second end edge and the third fold line. A first machine-activated adhesive pattern provided on the first face of one or both of the first and fourth panels for joining the first and fourth panels together along the longitudinal edges and adjacent the first and third fold lines for forming a return envelope when the sheet is folded about the second fold line. First and second longitudinal lines of weakness formed in the second and third panels parallel to and adjacent, but spaced from, the first and second longitudinal edges, respectively, the lines of weakness defining with the longitudinal edges first and second longitudinal margin portions. Second and third machine-activated adhesive patterns disposed on the first face of the sheet in the first and second longitudinal margin portions for holding the second and third panels together when the sheet is folded about the second fold line. A first end line of weakness formed in the sheet parallel to and adjacent, but spaced from, the second end edge to define a first end margin portion. A fourth line formed in the sheet parallel to and adjacent, but spaced from, the first end edge to define a reply envelope flap portion. A recipient-activated strip of adhesive disposed on the first face of the reply envelope flap portion. Fourth machine-activated adhesive patterns disposed on the first face of the sheet in one or both of the first end margin portion and reply envelope flap portion, the fourth patterns comprising widely spaced shapes of adhesive for tacking the first and second end edges of the sheet together when the sheet is folded about the second fold line to provide a mailer. And, fifth machine-activated adhesive patterns disposed on the second face of the sheet in one or both of the first and second panels, or third and fourth panels, in the reply envelope flap or the first end margin, and adjacent the second fold line, respectively, the fifth patterns comprising widely spaced shapes of adhesive for tacking the first and second panels, or third and fourth panels, together when the sheet is folded about the first, second and third fold lines, to provide readily releasable attachment therebetween.

The fifth machine activated adhesive patterns are preferably disposed on one or both of the reply envelope flap portion, and the second panel second face adjacent the second fold line, and reply address indicia is imaged on the second face of the first panel. Outgoing address indicia is imaged on the second face of the third panel, and the second faces of the panels are devoid of adhesive along or parallel to the longitudinal edges thereof. Also the first and third lines typically are lines of weakness (such as perforations).

A third longitudinal line of weakness also is preferably formed in the second panel between the first and second fold lines and defining the second panel into statement and remittance portions, which have variable statement indicia and variable remittance indicia, respectively, imaged on the second faces thereof. Typically the machine-activated adhesive patterns are pressure-activated cohesive, such as used with the Moore Business Forms, Inc. SPEEDISEALER® pressure seal equipment, and the recipient activated adhesive pattern is rewettable adhesive (or pressure sensitive adhesive covered by a release strip).

The intermediate according to the invention is constructed into a mailer by folding along first the second fold line, and then along the first and third fold lines, so that the first face of all panels is in the interior of the mailer, and also so that the second faces of the first and second panels are in the interior, with the second faces of the third and fourth panels providing the exterior of the mailer. In the mailer formed by this folding, four plies are provided, the first ply comprising the third panel, the second ply the second panel, the third ply the first panel, and the fourth ply the fourth panel.

The invention also comprises a multi-ply mailer with built in return envelope. The mailer comprises the following elements: First, second, third, and fourth plies of virtually identical dimensions, each having first and second faces, longitudinal edges, and end edges. The first ply having outgoing address indicia imaged on the first face thereof, the first face being an exterior face of the mailer. First and second adhesive patterns for connecting the second face of the first ply to the face of the second ply together in margin portions adjacent the longitudinal edges of the first and second plies. First and second longitudinal lines of weakness disposed on the opposite side of the first and second adhesive patterns from the longitudinal edges for allowing detachment of the first and second plies adjacent the longitudinal edges. The first face of the third ply having reply address indicia imaged thereon. A third adhesive pattern disposed between the second face of the third ply and the first face of the fourth ply for connecting the third and fourth plies together along three edges thereof to form a reply envelope. The third and fourth plies being devoid of longitudinal lines of weakness. And, a fourth adhesive pattern disposed between the second face of the second ply and the first face of the third ply along at least one end edge thereof, but not along the longitudinal edges thereof, the fourth adhesive pattern comprising widely spaced shapes of adhesive for tacking the second and third plies together to provide readily releasable attachment therebetween, the second ply second face and the third ply first face being devoid longitudinal adhesive patterns.

The second and third plies are tacked together by the fourth adhesive pattern along one edge thereof and are connected together by a line of weakness at the other edge thereof. In fact, preferably the first ply is connected to both the second and fourth plies at the end edges thereof by lines of weakness, and the second ply is connected to both the first and third plies at the end edges thereof by lines of weakness, so that the mailer is constructed by double folding a single sheet of paper.

Preferably the third adhesive pattern connects the third and fourth plies together along both longitudinal edges thereof and along the first end edge of the fourth ply. A reply envelope flap is formed in the third ply, and a detachable stub is formed in the fourth ply by a line of weakness parallel to the second edge so that the flap and detachable stub have essentially the same width. A recipient activated adhesive strip (e.g. rewettable adhesive) is disposed on the second face of the third ply in the reply envelope flap. A fifth adhesive pattern is disposed between the detachable stub and the reply envelope flap, the fifth pattern comprising widely spaced shapes of adhesive tacking the third and fourth plies together adjacent the second edges thereof to provide readily detachable attachment therebetween.

The third longitudinal line of weakness may be formed in the second ply between the first and second longitudinal lines of weakness to separate the second ply into remittance and statement portions, the remittance portion having variable remittance indicia, and the statement portion having variable statement indicia., imaged on the second face thereof. Further, indicia indicating how to open the mailer may be imaged on the first face of the first ply in at least one of the longitudinal margin portions.

It is the primary object of the present invention to provide an advantageous mailer type business form, and intermediate, having a built in reply envelope. This and other objects of the invention will become clear from an inspection of the detailed description of the invention and from the appended claims.

BRIEF DESCRIPTION OF THE DRAWINGS

FIG. 5 is a rear view of the mailer of FIG. 4;

FIG. 6 is a top perspective view of the front of the mailer of FIGS. 4 and 5 showing opening thereof by the recipient; and FIG. 7 is an exploded perspective view showing the various components of the mailer of FIGS. 4 through 6 after it has been completely open.

DETAILED DESCRIPTION OF THE DRAWINGS

Figure 1:
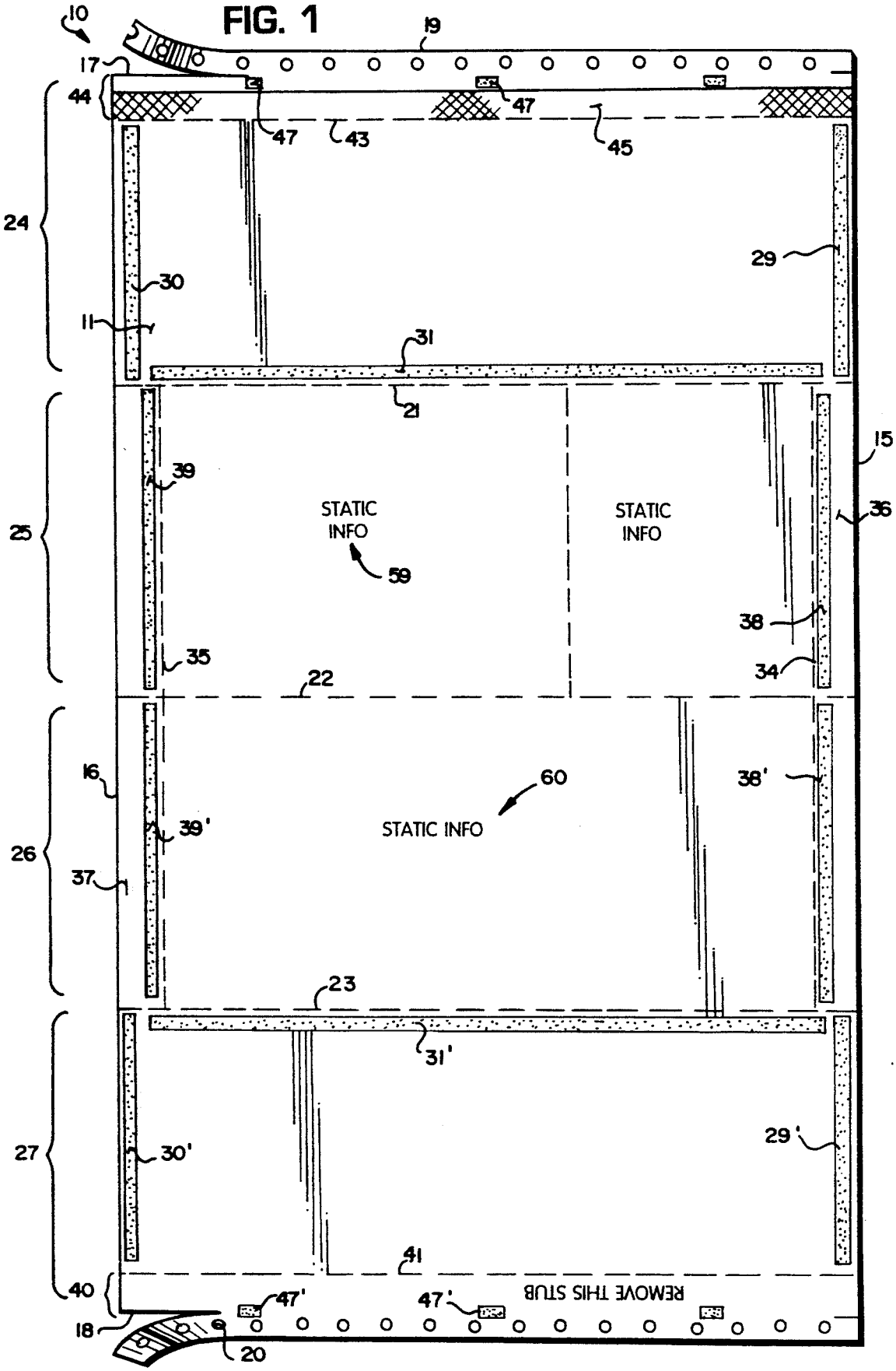
FIG. 1 is a top plan view of an exemplary mailer type business form intermediate according to the invention.
Figure 2:
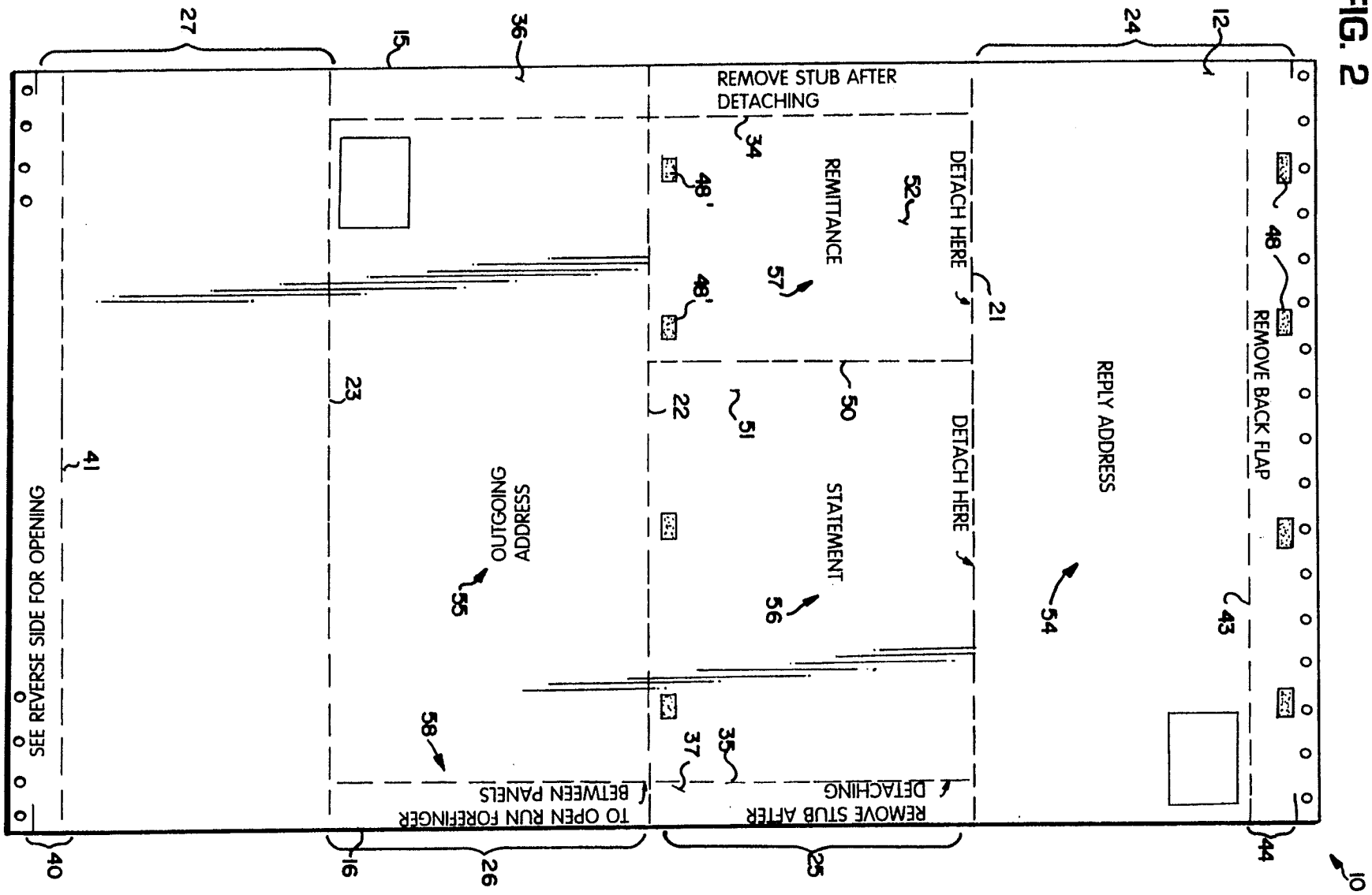
FIG. 2 is a top plan view of the second face of the intermediate of FIG. 1.

FIGS. 1 and 2 illustrate an intermediate for a mailer type business form according to the present invention, shown generally by reference numeral 10. The intermediate 10 comprises a sheet of paper (such as bond paper) having a first face 11. (FIG. 1) and a second face 12 (FIG. 2). The first face 11 is adapted to provide the majority of the interior of the mailer 13 (FIGS. 3 through 6) that is constructed from the intermediate 10, and the second face 12 is adapted to provide the exterior of the mailer 13 (as well as interior portions thereof too).

The sheet forming intermediate 10 has first and second opposite parallel longitudinal edges 15, 16, and opposite end edges 17, 18. When originally formed in continuous format, the edges 15, 16 are perf lines connecting the sheet to a like adjacent sheet, and tractor drive strips 19, 20 (see FIG. 1) are provide at the end edges 17, 18 respectively. However one of the final operations in the construction of the intermediate 10 is for tractor drive strip portions 19, 20 to be slit from the rest of the sheet by a conventional slitting mechanism.

The sheet forming the intermediate 10 has first, second, and third fold lines 21, 22, 23, respectively, which extend perpendicular to the longitudinal edges 15, 16, and parallel to the end edges 17, 18. The fold lines 21 through 23, which preferably comprise lines of weakness (such as perforations), divide the sheet forming the intermediate 10 into four virtually identical size panels: a first panel 24 formed between the edge 17 and the first fold line 21; a second panel 25 provided between the first and second fold lines 21, 22; a third panel 26 provided between the second and third fold lines 22, 23; and a fourth panel 27 provided between the third fold line 23 and end edge 18.

A reply envelope is constructed from the first and fourth panels 24, 27 by a first machine-activated adhesive pattern provided on the first face 11 of one or both of the panels 24, 27, along three of the four edges thereof. In the exemplary embodiment illustrated in the drawings, the first machine-activated adhesive pattern comprises the longitudinal strips 29, 30 adjacent the edges 15, 16, respectively, in the first panel, and the transverse strip 31 adjacent the first fold line 21. Especially where the machine-activated adhesive forming the strips 29 through 31 is pressure-activated cohesive such as provided by Moore Business Forms, Inc:. of Lake Forest, Ill., a set of aligned strips 29' through 31' will be provided on the first face 11 of the fourth panel 27. The panels 24, 27 provide the reply envelope—shown by reference numeral 33 in FIG. 7—in the final mailer constructed.

The intermediate 10 also preferably comprises first and second longitudinal lines of weakness (e.g. perforations) 34, 35 formed in the second and third panels 25, 26 parallel to and adjacent, but spaced from, the edges 15, 16, respectively. The lines of weakness 34, 35 define with the edges 15, 16 longitudinal margin portions 36, 37 in the panels 25, 26.

Disposed in the longitudinal margin portions 36, 37 are second and third machine-activated adhesive patterns. The adhesive patterns may be in just one of the panels 25, 26, or—as illustrated in FIG. 1—in both panels. For example a strip 38 is provided in margin portion 36 of second panel 25, and a strip 39 in margin portion 37 of second panel 25, with aligned substantially identical strips 38', 39' in the third panel 26. Note that strips 38, 38' and 39, 39' are placed inwardly from the strips 29, 29' and 30, 30' so that there is no more than a double thickness of adhesive at any point along the longitudinal edges 15, 16 of the mailer 13 constructed from the intermediate 10.

The intermediate 10 also comprises a first end line of weakness formed in the sheet forming the intermediate: 10, parallel to and adjacent, but spaced from, second end edge 18, to define a first end margin portion 40. This first end line of weakness is shown by reference numeral 41 (see FIGS. 1 through 3). The intermediate 10 also comprises a fourth fold line 43 (which may be a perforation line) parallel to and adjacent, but spaced from, the first end edge 17 to define a reply envelope flap portion 44. A recipient-activated strip of adhesive, such as a rewettable adhesive strip 45 (see FIGS. 1 and 7) is disposed on the first face 11 of the reply envelope flap portion 44. The flap portion 44 and the removable stub 40 have substantially the same dimensions.

Fourth machine-activated adhesive patterns 47, 47' may be provided which "tack" the panels 24, 27 together when the sheet forming the intermediate 10 is folded about the second fold line 22 to provide a mailer 13. By merely tacking the end edges 17, 18 together rather than securely holding them together (as takes place with the strips 29 through 31, etc. ), the patterns 47, 47' allow the recipient to readily detach the panels at the adhesive patterns to allow opening of the mailer 13. In the exemplary embodiment illustrated in FIG. 1, the fourth patterns comprise three small rectangles 47 provided on the flap 44 just above the rewettable adhesive strip 45, with aligned comparable small rectangles 47 provided on the stub 40. The patterns 47, 47' take up less than a quarter of the width of the intermediate 10, preferably substantially less, as illustrated in FIG. 1.

The intermediate 10 also comprises fifth machine-activated adhesive patterns disposed on a second face 12 (see FIG. 2). The fifth adhesive patterns, shown in the form of widely spaced shapes (e.g. rectangles) 48, 48', are for tacking either the first and second, or third and fourth, panels together after folding about the first and third lines 21, 23. Note that the patterns 48, 48' are staggered with respect to the patterns 47, 47' so that at no point along the end portions of the mailer 13 constructed from the intermediate 10 will there be a double thickness of adhesive. In the embodiment illustrated in the drawings (see FIGS. 2, 3, and 6) the patterns 48 are shown disposed on the face 12 of the return envelope flap 44, with aligned cooperating shapes 48' disposed on the face 12 of the second panel 25 adjacent the second fold line 22, although depending upon exactly how the panels are imaged or otherwise constructed, the shapes 48, 48' could be provided in corresponding portions of the third and fourth panels 26, 27 instead. The shapes 48, 48'—like the shapes 47, 47'—cover much less than a quarter of the width of the intermediate 10, and provide readily releasable "tacking" of the components together. Note that there are no longitudinal adhesive patterns provided on the face 12 (although small "tacking" shapes could be provided if necessary) in order to facilitate easy opening of the mailer 13.

Another constructional feature of the intermediate 10 that is advantageous, especially when it is used as a mailer for a statement, is another longitudinal line of weakness 50 that is provided between the first and second fold lines 21, 22 and the second panel 25 and separates the second panel 25 into a statement portion 51 (between the perforations 21, 22, 35, and 50) and a remittance portion 52 (between the perforations 21, 22, 34, and 50).

When using the intermediate 10, all of the variable information associated therewith may be simplex printed or otherwise imaged—that is only the face 12 need be through the printer to have variable indicia applied thereto, there being no necessity for duplex printing or for inverting the intermediate 10. In the preferred embodiment of the invention, the reply address indicia 54 is printed on the second face 12 of the first panel 24 while outgoing address indicia is printed on face 12 of third panel 26 as indicated at 55 in FIGS. 2, 4, and 6 (the indicia 55 being "upside down" with respect to the indicia 54 on the intermediate 10). Variable statement indicia (such as account number, amount of payment due) is printed at 56 on face 12 of second panel 25 and statement portion 51, while variable remittance data (generally comparable to the statement data) is printed on remittance portion 52. Indicia. 58 is preferably printed in the margin 37 (or both margins 36 and 37) on face 12, and particularly of third panel 26, to provide easily viewed instructions to the recipient of the mailer 13 on how to open it. Non-variable indicia 59, 60 may be printed on the first face 11 of the panels 25, 26.

Figure 3:
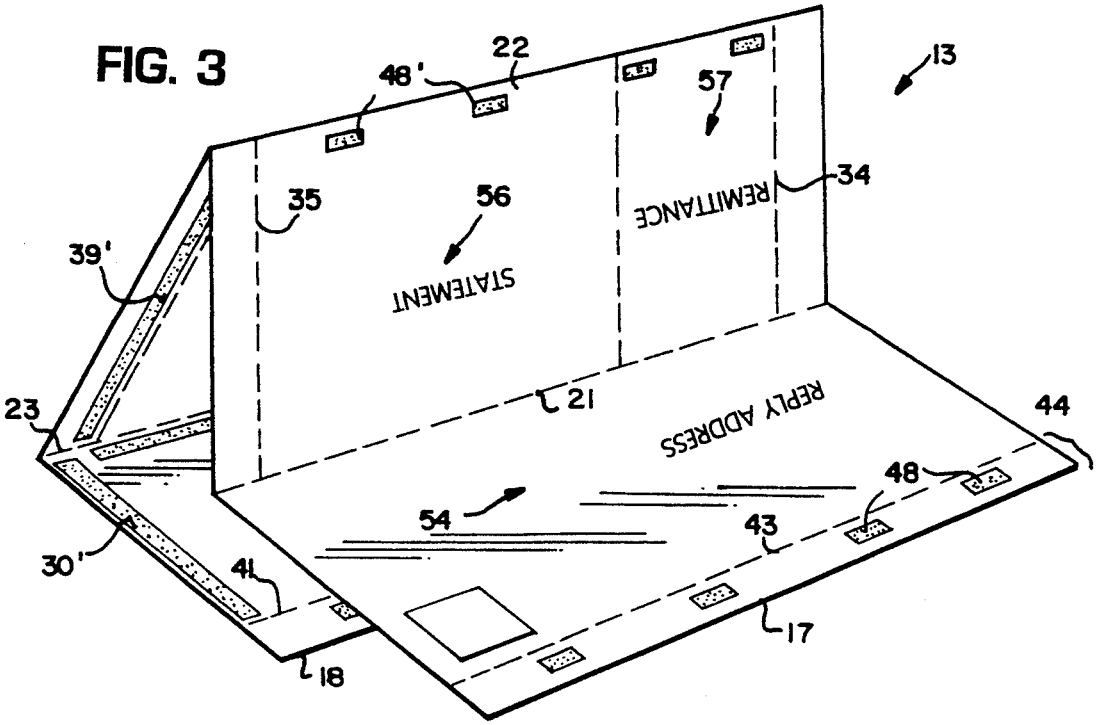
FIG. 3 is a top perspective view showing folding of the intermediate of FIGS. 1 and 2 about all three fold lines to provide a mailer according to the invention.
Figure 4:
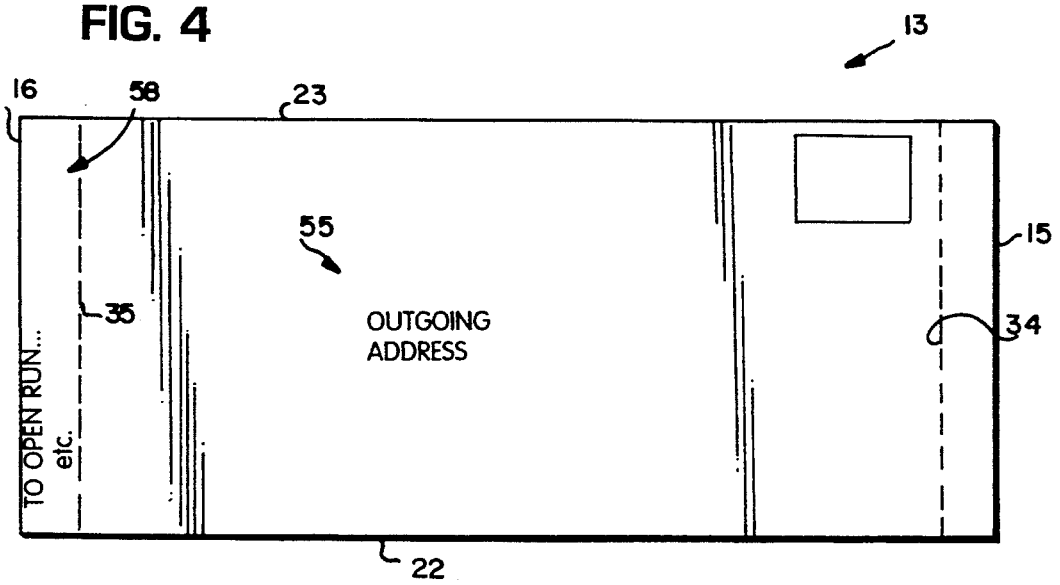
FIG. 4 is a front view of an exemplary mailer constructed from the intermediate of FIGS. 1 and 2.

FIG. 3 illustrates folding of the intermediate 10 to produce the mailer 13. Note that the sheet forming the intermediate 10 is first folded about the second fold line 22 so that the faces 11 of the panels 25, 26 come into face-to-face contact, and the faces 11 of the panels 27 come into contact. Subsequent folding then takes place about first and third fold lines 21, 23, which are aligned at that time. Then the mailer 13 is passed through SPEEDISEALER ® pressure sealer, or comparable heat seal equipment if the adhesive patterns 29–31, 38, 39, 47, (and like "'" components) are heat seal machine-activated adhesives, to form the completed mailer 13 illustrated in FIGS. 4 and 5. When the final mailer 13 is constructed, the third panel 26 comprises the first (top) ply of the mailer 13 with the face 12 being the exterior face, the second panel 25 becomes the second ply, the first panel 24 becomes the third ply, and the fourth panel 27 becomes the fourth ply, with the second face 12 thereof the exterior of the mailer 13.

Once the mailer 13 is received by the outgoing addressee, the recipient opens the mailer 13 according to the indicia 58, by sticking his or her finger (shown at 62 in FIG. 6) between the first and second panels 24, 25 along either the side edges 15, 16, where there is no adhesive. Then by moving the finger 62 toward the opposite edge (edge 15 in FIG. 6) and downwardly in FIG. 5, the widely spaced adhesive portions 48, 48' holding the "edges" 17, 22 together provides the first stage of opening. Then second and third panels 25, 26 are separated from the first and fourth panels 24, 27 by tearing along the perforation lines 21, 23 (see FIG. 7), and the margin portions 36, 37 are removed by tearing along perforation lines 34, 35, resulting in separation of the second and third panels 25, 26 from each other.

Tearing also takes place along the perforation line 50 to separate the second panel 25 into the statement portion 51 and remittance portion 52. Stub 40 is also removed by tearing along perforation 41, detachment by the adhesive portions 47, 47' readily taking place. The recipient then inserts the remittance portion 52 and his or her check into the reply envelope 33, bends the flap 44 about the fold line 43 and wets the rewettable adhesive strip 45, seals the reply envelope 33, and then mails it to the reply address 54.

It will thus be seen that according to the present invention an intermediate is provided which can be simplex printed or otherwise imaged to provide a mailer type business form with a great deal of area provided for imaging, and with a built in return envelope. The mailer type business form constructed according to the invention is easy to construct, easy to open, and has an easily used reply envelope.

While the invention has been herein shown and described in what is presently conceived to be the most practical and preferred embodiment it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A mailer type business form intermediate comprising:

a sheet of paper having first and second opposite parallel longitudinal edges; first and second opposite end edges; a first face adapted to provide the majority of the interior of a mailer when constructed from the sheet; and a second face adapted to provide the exterior of the mailer when constructed;

first, second and third fold lines formed in said sheet perpendicular to said longitudinal edges, and dividing said sheet into, in sequence, first, second, third, and fourth panels of virtually identical size, said first panel being defined by said first end edge and said first fold line, and said fourth panel by said second end edge and said third fold line;

a first machine-activated adhesive pattern provided on said first face of at least of said first and fourth panels for joining said first and fourth panels together along said longitudinal edges and adjacent said first and third fold lines for forming a replay envelope when said sheet is folded about said second fold line;

first and second longitudinal lines of weakness formed in said second and third panels parallel to and adjacent, and spaced from, said first and second longitudinal edges, respectively, said lines of weakness defining with said longitudinal edges first and second longitudinal margin portions;

second and third machine-activated adhesive patterns, disposed on said first face of said sheet in said first and second longitudinal margin portions for holding said second and third panels together when said sheet is folded about said second fold line, a first end line of weakness formed in said sheet parallel to and adjacent, and spaced from, said second end edge to define a first end margin portion;

a fourth fold line formed in said sheet parallel to and adjacent, and spaced from, said first end edge to define a reply envelope flap portion;

a recipient-activated strip of adhesive disposed on said first face of said reply envelope flap portion;

fourth machine-activated adhesive patterns disposed on said first face of said sheet in at least one of said first end margin portion and reply envelope flap portion, said fourth patterns comprising widely spaced shapes of adhesive for tacking said first and second end edges of said sheet together when said sheet is folded about said second fold line to provide a mailer; and fifth machine-activated adhesive patterns disposed on said second face of said sheet in at least one of said first and second panels, and third and fourth panels; said fifth adhesive patterns in one of said reply envelope flap and said first end margin, and adjacent said second fold line, respectively, said first patterns comprising widely spaced shapes of adhesive for tacking at least one of said first and second panels, and third and fourth panels, together when said sheet is folded about said first, second and third fold lines, to provide readily releasable attachment therebetween.

2. An intermediate as recited in claim 1 wherein said fifth machine-activated adhesive patterns are disposed on at least one of said reply envelope flap portion, and said second panel second face adjacent said second fold line.

3. An intermediate as recited in claim 2 further comprising reply address indicia imaged on said second face of said first panel.

4. An intermediate as recited in claim 3 further comprising outgoing address indicia imaged on said second face of said third panel.

5. An intermediate as recited in claim 2 wherein said second faces of said first and second panels are devoid of adhesive patterns along said longitudinal edges.

6. An intermediate as recited in claim 1 wherein said second faces of all of said panels are devoid of adhesive patterns along said longitudinal edges.

7. An intermediate as recited in claim 1 wherein said first and third fold lines are lines of weakness,

8. An intermediate as recited in claim 1 further comprising a third longitudinal line of weakness formed in said second panel between said first and second fold lines, and defining said second panel into statement and remittance portions.

9. An intermediate as recited, in claim 8 further comprising variable statement indicia imaged on said second face of said second panel statement portion, and variable remittance indicia imaged on said second face of said second panel remittance portion.

10. An intermediate as recited in claim 1 wherein said machine-activated adhesive patterns are pressure-activated cohesive, and wherein said recipient-activated adhesive pattern is rewettable adhesive.

11. A multi-ply mailer with a built in reply envelope, comprising:

first, second, third, and fourth plies of virtually identical dimensions, each having first and second faces, longitudinal edges, and end edges;

said first ply having outgoing address indicia imaged on said first face thereof, said first face being an exterior face of said mailer;

first and second adhesive patterns for connecting said second face of said first ply to said first face of said second ply together in margin portions adjacent said longitudinal edges of said first and second plies;

first and second longitudinal lines of weakness disposed on the opposite side of said first and second adhesive patterns from said longitudinal edges for allowing detachment of said first and second plies adjacent said longitudinal edges;

said first face of said third ply having reply address indicia imaged thereon;

a third adhesive pattern disposed between said second face of said third ply and said first face of said fourth ply for connecting said third and fourth plies together along three edges thereof to form a reply envelope;

said third and fourth plies being devoid of longitudinal lines of weakness; and a fourth adhesive pattern disposed between said second face of said second ply and said first face of said third ply along at least one end edge thereof, and not along said longitudinal edges thereof, said fourth adhesive pattern comprising widely spaced shapes of adhesive for tacking said second and third plies together to provide readily releasable attachment therebetween, said second ply second face and said third ply first face being devoid of longitudinal adhesive patterns.

12. A mailer as recited in claim 11 wherein said second and third plies are tacked together by said fourth adhesive pattern along one end edge thereof, and are connected together by a line of weakness at the other end edge thereof.

13. A mailer as recited in claim 11 wherein said first and fourth plies are connected together by a line of weakness at a first end edge of each.

14. A mailer as recited in claim 13 wherein said third adhesive pattern connects said third and fourth plies together along both longitudinal edges thereof and along said first end edge of said fourth ply; and further comprising a reply envelope flap formed in said fourth ply adjacent a second end edge thereof, opposite said first end edge, and a detachable stub formed in said third ply adjacent said second end edge thereof.

15. A mailer as recited in claim 13 wherein said third adhesive pattern connects said third and fourth plies together along both longitudinal edges thereof and along said first end edge of said fourth ply; and further comprising a reply envelope flap formed in said third ply adjacent a second end edge thereof, opposite said first end edge, and a detachable stub formed in said fourth ply adjacent said second end edge thereof.

16. A mailer as recited in claim 15 further comprising a fifth adhesive pattern disposed between said detachable stub and said reply envelope flap, said fifth pattern comprising widely spaced shapes of adhesive tacking said third and fourth plies together adjacent said second edges thereof to provide readily detachable attachment therebetween.

17. A mailer as recited in claim 15 wherein said reply envelope flap is formed in said third ply, and wherein said detachable stub is formed in said fourth ply by a line of weakness parallel to said second edge so that said flap and detachable stub have essentially the same width; and further comprising a recipient-activated adhesive strip disposed on said second face of said third ply in said reply envelope flap.

18. A mailer as recited in claim 11 further comprising a third longitudinal line of weakness formed in said second ply between said first and second longitudinal lines of weakness to separate said second ply into remittance and statement portions, said remittance portion having variable remittance indicia imaged on said second face thereof, and said statement portion having variable statement indicia imaged on said second face thereof.

19. A mailer as recited in claim 11 further comprising indicia indicating how to open said mailer imaged on said first face of said first ply in at least one of said longitudinal margin portions.

20. A mailer as recited in claim 11 wherein said adhesive patterns are formed by pressure-activated cohesive.

21. A mailer as recited in claim 11 wherein said first ply is connected to both said second and fourth plies at the end edges thereof by lines of weakness, and said second ply is connected to both said first and third plies at the end edges thereof by lines of weakness.

* * * * *